US009704460B2

(12) United States Patent
Hacker

(10) Patent No.: US 9,704,460 B2
(45) Date of Patent: Jul. 11, 2017

(54) DEVICE FOR IMPLEMENTING A SNARE EFFECT ON OTHER DRUM CONFIGURATIONS

(71) Applicant: Scott A. Hacker, Linden, PA (US)

(72) Inventor: Scott A. Hacker, Linden, PA (US)

( * ) Notice: Subject to any disclaimer, the term of this patent is extended or adjusted under 35 U.S.C. 154(b) by 0 days.

(21) Appl. No.: 15/075,134

(22) Filed: Mar. 19, 2016

(65) Prior Publication Data

US 2016/0275924 A1 Sep. 22, 2016

Related U.S. Application Data

(60) Provisional application No. 62/135,207, filed on Mar. 19, 2015.

(51) Int. Cl.
*G10D 13/02* (2006.01)

(52) U.S. Cl.
CPC ..... *G10D 13/025* (2013.01)

(58) Field of Classification Search
CPC ..... G10D 13/025
USPC ..... 84/415
See application file for complete search history.

(56) References Cited

U.S. PATENT DOCUMENTS 1,565,329 A 5/1923 Robison
3,433,115 A * 3/1969 Kjelstrom ..... G10D 13/00 84/411 M
4,121,493 A 10/1978 May
4,242,937 A 1/1981 Pozar
4,278,003 A 7/1981 Hanson
4,688,463 A 8/1987 Kurosaki
4,909,125 A 3/1990 Fece
5,337,645 A 8/1994 Johnston
5,877,440 A * 3/1999 Chaffee ..... G10D 13/022 84/411 M
7,074,994 B2 7/2006 Belli
7,498,501 B1 * 3/2009 Hsieh ..... G10D 13/025 84/415
9,466,273 B2 * 10/2016 Krol ..... G10D 13/025
2009/0133564 A1 * 5/2009 Miyajima ..... G10D 13/025 84/415
2010/0242707 A1 * 9/2010 Miyajima ..... G10D 13/025 84/415
2011/0023686 A1 * 2/2011 Nakata ..... G10D 13/025 84/415
2014/0174278 A1 * 6/2014 Yu ..... G10D 13/025 84/413

* cited by examiner

*Primary Examiner* — Jianchun Qin
(74) *Attorney, Agent, or Firm* — Wendy W. Koba

(57) ABSTRACT

A device for incorporating a snare effect with an existing drum is formed of a collection of snare wires attached to a mounting configuration. The snare wires are of a length that extends across only a portion of a drum head, with the device attached to an accessible area on an existing drum. In one configuration, the device includes a lever arm that controls the contact between the snare wires and the drum head. The snare device can be attached to the underside of a roto-tom drum (for example), and provide an adjustable pitch snare effect. The snare device can be attached to an exterior portion (tension hoop, for example) or an interior portion (shell) of a shelled drum, and provide the snare effect.

6 Claims, 10 Drawing Sheets

DEVICE FOR IMPLEMENTING A SNARE EFFECT ON OTHER DRUM CONFIGURATIONS

CROSS-REFERENCE TO RELATED APPLICATIONS

This application claims the benefit of U.S. Provisional Application Ser. No. 62/135,207, filed Mar. 19, 2015 and herein incorporated by reference.

TECHNICAL FIELD

The present invention relates to a device for producing a snare drum effect and, more particularly, to a device that may be attached to an existing drum of another type (e.g., adjustable-pitch timpani drum, floor tom, mounted tom, etc.) to allow the musician to produce a snare drum sound from the existing drum.

BACKGROUND OF THE INVENTION

Adjustable-pitch drums are well known in the art. See, for example, U.S. Pat. Nos. 4,048,895 and 4,121,493 (among others) issued to R. L. May. As discussed in these patents, a pitch-changing mechanism is mounted on the drum shell, and controlled by the musician to change the pitch of the drum by rotating the drum (the drum affixed to a threaded rod positioned vertical within the drum shell). Rotation of the drum functions to increase or decrease the tension of the drum head and the pitch of the drum (depending on the direction of rotation).

In most musical ensembles, a variety of different percussion instruments are used. There are instances where it would be convenient to include a snare drum for a particular event or musical performance, but the cost, size and various other component requirements makes it prohibitive to provide multiple numbers of drums for each event.

The ability to add a snare effect to another drum has a variety of uses, and is particularly advantageous in that the number of different drums that are needed to provide different sounds is reduced. For example, in trap sets, stage events, recording sessions, marching band events, and the like, the ability to reduce the number of different physical elements (in this case, drums), is always beneficial (particularly from an economic point of view, as well as efficiency of packing and unpacking instruments).

While the advent of the adjustable-pitch timpani drum has allowed for some additional features to be added to different musical performances, there is still a requirement in most cases to provide various sizes and types of snare drums, floor toms, mounted toms, roto-toms, etc.

SUMMARY OF THE INVENTION

The need remaining in the prior art is addressed by the present invention, which relates to a device for producing a snare drum effect and, more particularly, to a device that may be attached to an existing drum of another type (e.g., adjustable-pitch timpani drum, floor tom, mounted tom, etc.) to allow the musician to also produce a snare drum sound from the existing drum.

In accordance with one embodiment of the present invention, a snare takes the form of a plurality of snare wires that are held together at one end with a mounting bracket, with the opposite end of the plurality of snare wires remaining unattached. The snare device is attached to an accessible area of an existing drum in a manner allows for the snare wires to be brought into contact with the drum head. In an adjustable version of the inventive device, a lever arm may be included and used to move the snare wires such that either contact the drum head, or shifted away from the drum head, as controlled by the musician.

It is an advantage of the snare device of the present invention that a "shell-less" percussion instrument (such as a roto-tom drum) can be configured to produce a snare sound. As a result, it is possible to include a drum retro-fitted with the inventive snare device to form a "shell-less snare drum" that is lightweight and sturdy, with many fewer parts (and expense) than conventional snare drums. In particular, when used in conjunction with a roto-tom drum, the different tensions applied to the roto-tom head allow for a sensitivity to the snare wires that is very different from a conventional snare drum.

The inventive snare device may be attached to an interior portion of a drum (such as a part of a frame or a drum shell), or an exterior portion of a drum. Regardless of the area of attachment, the mounting elements are configured and designed to allow for the plurality of snare wires to contact a drum head.

It is an aspect of the present invention that the capability of providing a snare effect with an adjustable-pitch timpani drum (hereinafter referred to as a "roto-tom drum") creates a novel percussion feature in the form of an "adjustable-pitch" snare sound.

In accordance with another embodiment of the present invention, the adjustable snare device includes a movable lever arm that allows for the snare wires to be brought in contact with the drum head (producing the snare effect), or moved away from the drum head (reverting to the conventional percussion sound) as controlled by the musician.

An exemplary embodiment of the present invention takes the form of a snare device comprising a plurality of snare wires having a length L (the plurality of snare wires disposed in a planar configuration and having a first end termination and a second, opposing end termination), an end termination mount attached to the first end termination of the plurality of snare wires, a side bracket extending orthogonal from the end termination mount, and a clamping configuration attached to the side bracket and including a clamping device for attaching the snare device to a drum in a manner that the plurality of snare wires extend across a portion of a drum head.

Other and further aspects and features of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

Prior to describing the details and attributes of the inventive snare device, a basic description of a conventional roto-tom will be provided, allowing for the particulars of how the inventive snare device can be attached to this type of drum to be better understood.

Figure 1:
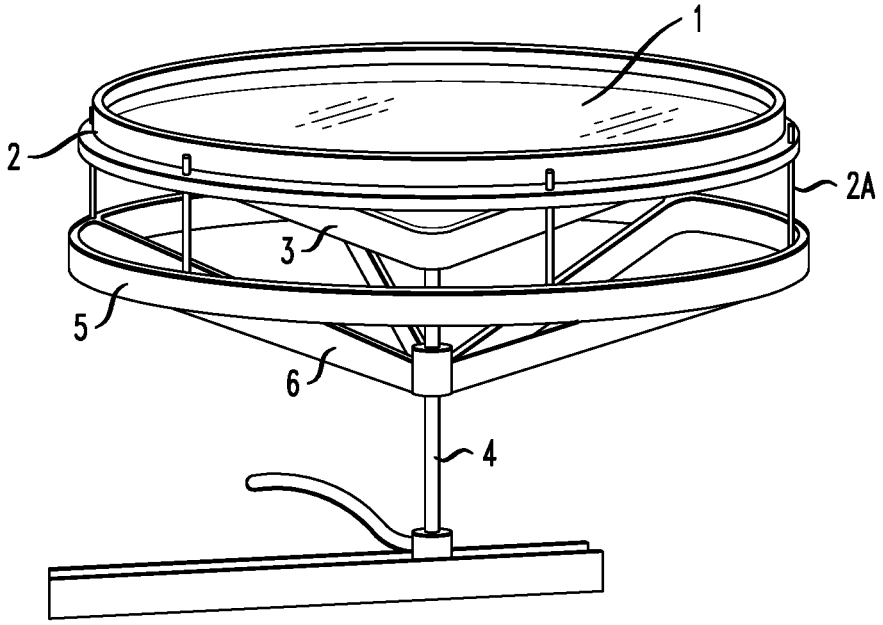
FIG. 1 illustrates a conventional, prior art adjustable-pitch roto-tom drum.

FIG. 1 illustrates a conventional roto-tom drum, which is shown as including a drum head 1 coupled to an upper ring 2. A number of arms 3 (often referred to as a "spider" configuration) extend outward from a central threaded rod 4 couple to separate locations on upper ring 2. Upper ring 2 is used to tune the drum. In particular, ring 2 tensions drum head 1 by tightening tension bolts 2A, where tension bolts 2A are shown as extending downward into lower ring 5.

In operation, upper ring 2 is rotated (clockwise or counterclockwise) to change the pitch of the roto-tom drum. As upper ring 2 is spun, central shaft 4 presses against spider mechanism 3, which either adds or releases pressure again the bottom of drum head 1 (depending on the direction that upper ring 2 is rotated), changing the pitch of the drum.

Figure 2:
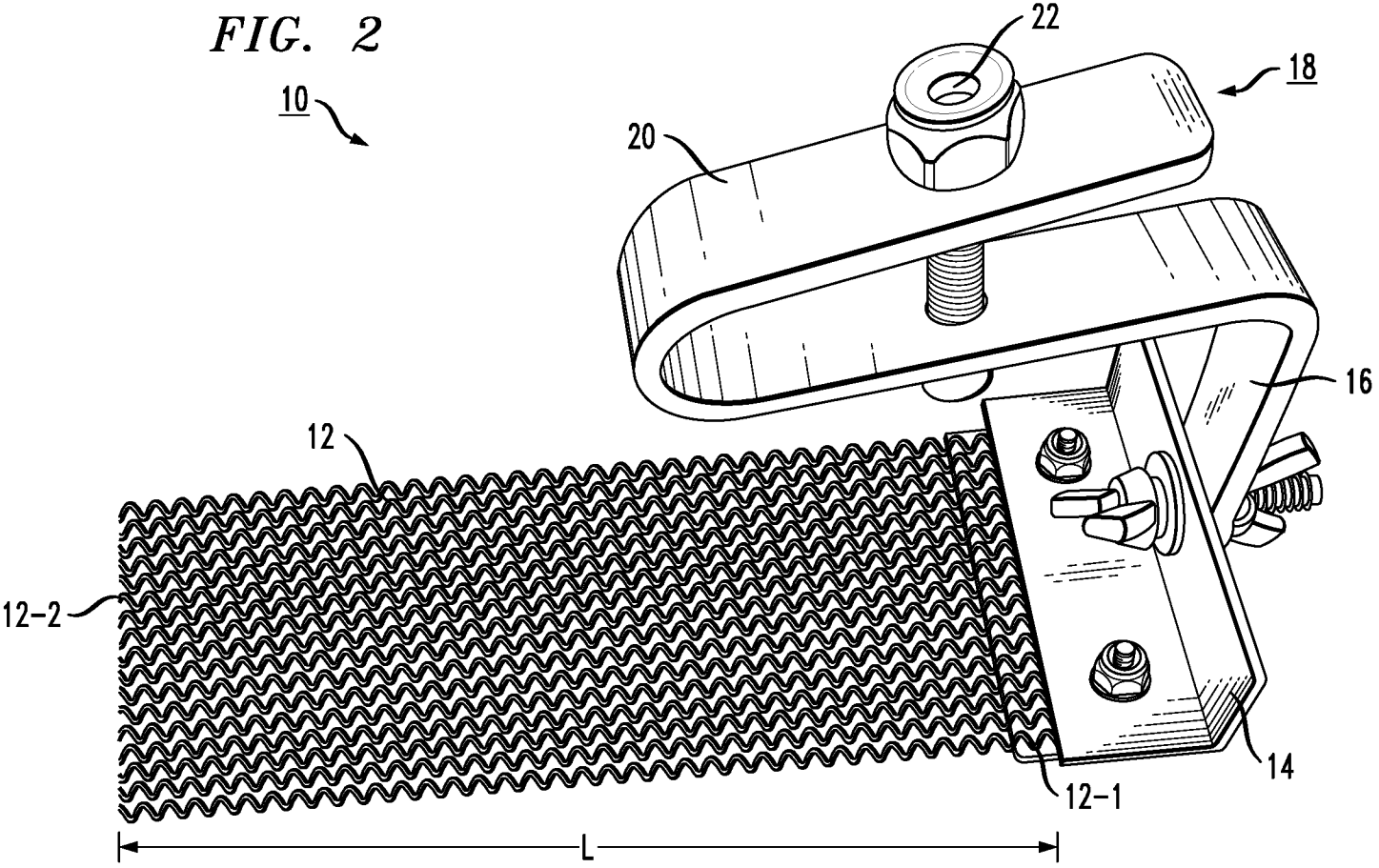
FIG. 2 shows an exemplary embodiment of the snare device of the present invention.

FIG. 2 illustrates an exemplary embodiment of a snare device 10, formed in accordance with one embodiment of the present invention, which may be added to an existing drum, such as the roto-tom drum shown in FIG. 1. As explained below, snare device 10 can be attached to an existing drum (for example, attached to the inner mechanism of an adjustable-pitch drum such as that shown in FIG. 1) to incorporate a snare drum effect with an existing drum.

For example, by virtue of incorporating the inventive snare device with a conventional roto-tom drum, an actual "snare drum" is created that requires one less drum head (that is, the inventive type of snare does not utilize a bottom snare head). Moreover, the need for a conventional snare drum shell is also eliminated, further reducing cost of a snare drum, as well as decreasing its size. The ability to rapidly control the defined pitch of the snare effect (by rotating the roto-tom drum) is clearly a novel feature and creates a new form of a drum. All of these advantages, among others, are considered to greatly increase the value of a roto-tom drum including the snare effect device formed in accordance with the present invention.

As will be described in detail below, snare device 10 does not disturb the general functionality of the existing drum. For example, when used in conjunction with a roto-tom drum, snare device 10 may attached to the interior of the spider mechanism. Thus, there are no visible changes to the drum itself. And in contrast to prior art roto-tom drums (as described in various ones of the above-referenced patents of R. L. May), the inventive snare device is not necessarily dependent on the attachment to an exterior shell (indeed, another option is to attach the snare device to a track-mounted center bolt, which functions to rapidly adjust the pitch).

Referring now to the particulars of FIG. 2, snare device 10 is shown as comprising a plurality of snare wires 12 that are attached to an end termination mount 14. The plurality of snare wires 12 are formed to exhibit a length L that is about half the diameter of the drum (an exact length is not required). A first end 12-1 of the plurality of snare wires 12 is attached to end termination mount 14, and a second end 12-2 of the plurality of snare wires 12 remains unattached to another component. When located in place under a drum head, snare wires 12 will contact a sufficient area of the head to provide the snare effect sound.

Continuing with the description of the components in FIG. 2, a side bracket 16 is shown as extending upward from end termination mount 14, with a clamping configuration 18 forming the opposing end termination of side bracket 16. In this case, clamping configuration includes a U-shaped fitting 20 that is coupled to an appropriate component of the existing drum. When used on a roto-tom drum (for example), U-shaped fitting 20 may be attached to an adjustable pitch mechanism of the drum (not shown in this view), with a screw clamp 22 used to affix snare device 10 to the drum mechanism.

Figure 3:
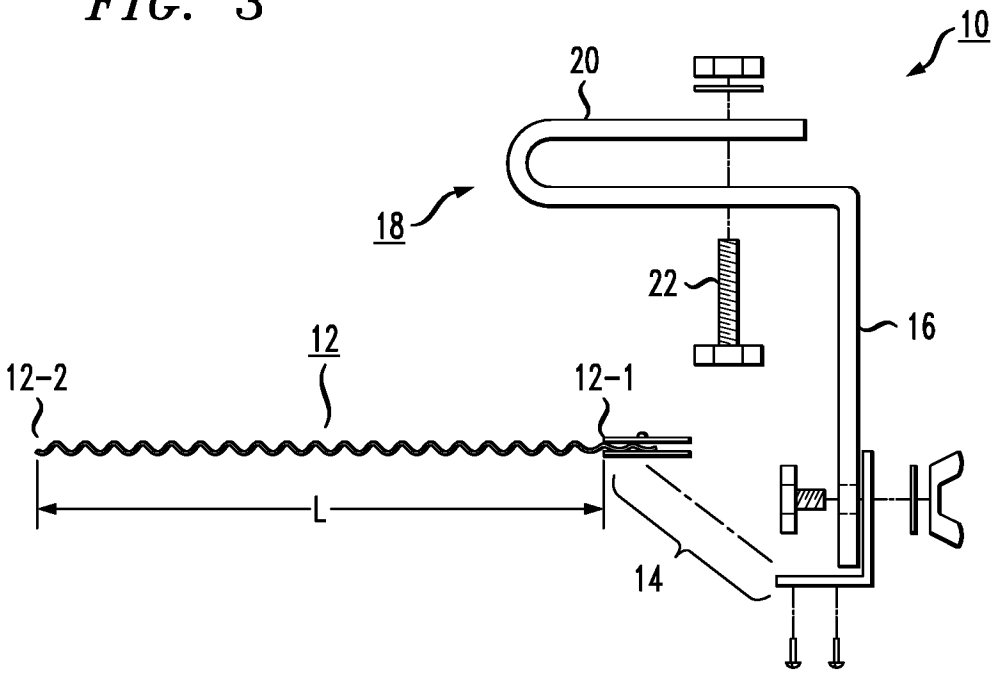
FIG. 3 is an exploded view of the snare device of FIG. 2.

FIG. 3 is an exploded view of snare device 10, showing each of the elements described above. That is, FIG. 3 illustrates a plurality of snare wires 12 that are attached to an end termination mount 14. The length L of the plurality of snare wires 12 is clearly shown in this view, as well as the first end termination 12-1 of the plurality of snare wires 12 that couples to end termination mount 14 (the "free end" 12-2 of the plurality of snare wires 12 is also clearly shown in this view).

Side bracket 16 is shown in FIG. 3 as extending upward from end termination mount 14, with clamping configuration 18 forming the opposing end termination of side bracket 16. As mentioned above, this particular arrangement of clamping configuration 18 includes U-shaped fitting 20 that is coupled to an appropriate component of the existing drum. In particular, clamping configuration is particularly designed to allow for snare device 10 to be attached to (for example) a spider arm of the adjustable pitch mechanism of a roto-tom drum, or a tension ring of a drum, or any other suitable location.

Figure 4:
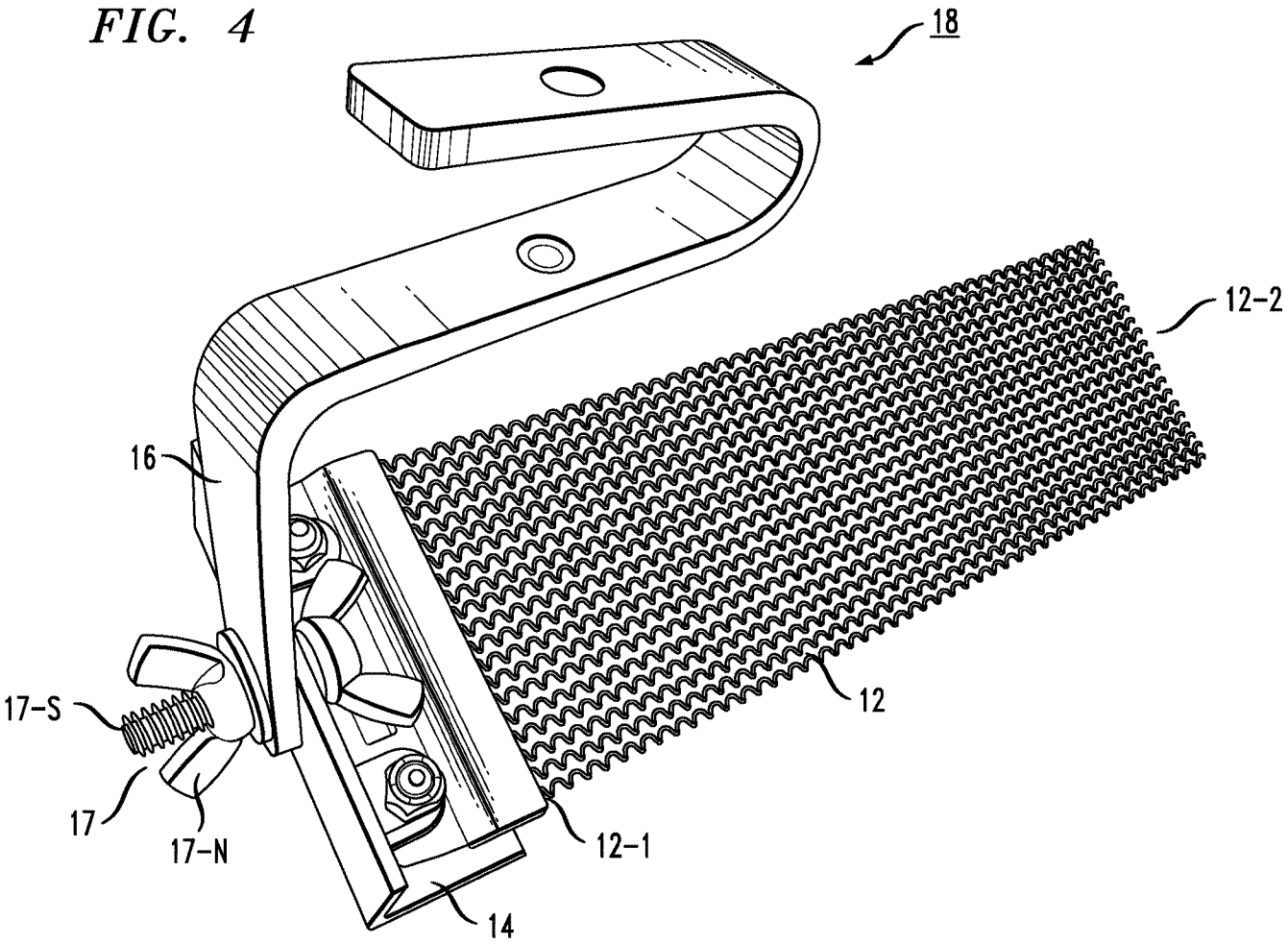
FIG. 4 shows another embodiment of a snare device formed in accordance with the present invention, in this case where the snare wires can be removed from the mounting configuration.

FIG. 4 illustrates an alternative to the embodiment shown in FIGS. 2 and 3, where in this case an attachment 17 in the form of wing nuts 17-N and a wing screw 17-S are used to attach end termination mount 14 to side bracket 16. In this alternative embodiment, it is possible to remove snare wires 12 (as well as end termination mount 14) once device 10 has been mounted onto a drum. Indeed, there may be instances where a musician wants to (temporarily) remove the snare effect from a given drum. The use of this wing nut type of attachment 17 is useful in providing a configuration with removable snare wires.

Figure 5:
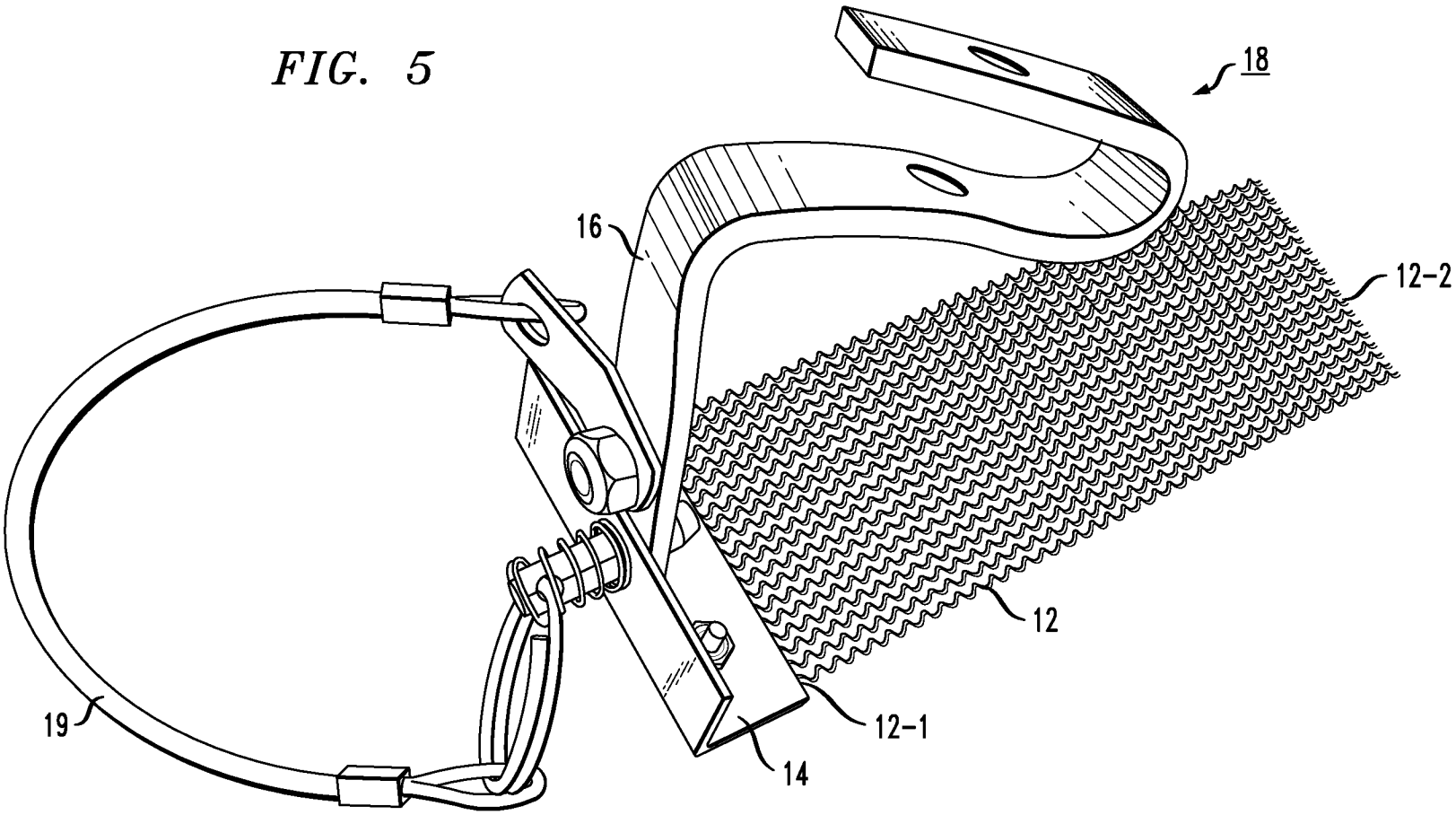
FIG. 5 shows yet another embodiment of the inventive snare device, including an alternative removable configuration for attaching the snare wires to the mounting configuration.

Another alternative embodiment of snare device 10 is shown in FIG. 5, where in this case a quick-release lanyard 19 arrangement is used to allow end termination mount 14 (and attached snare wires 12) to be dis-engaged from side bracket 16.

Figure 6:
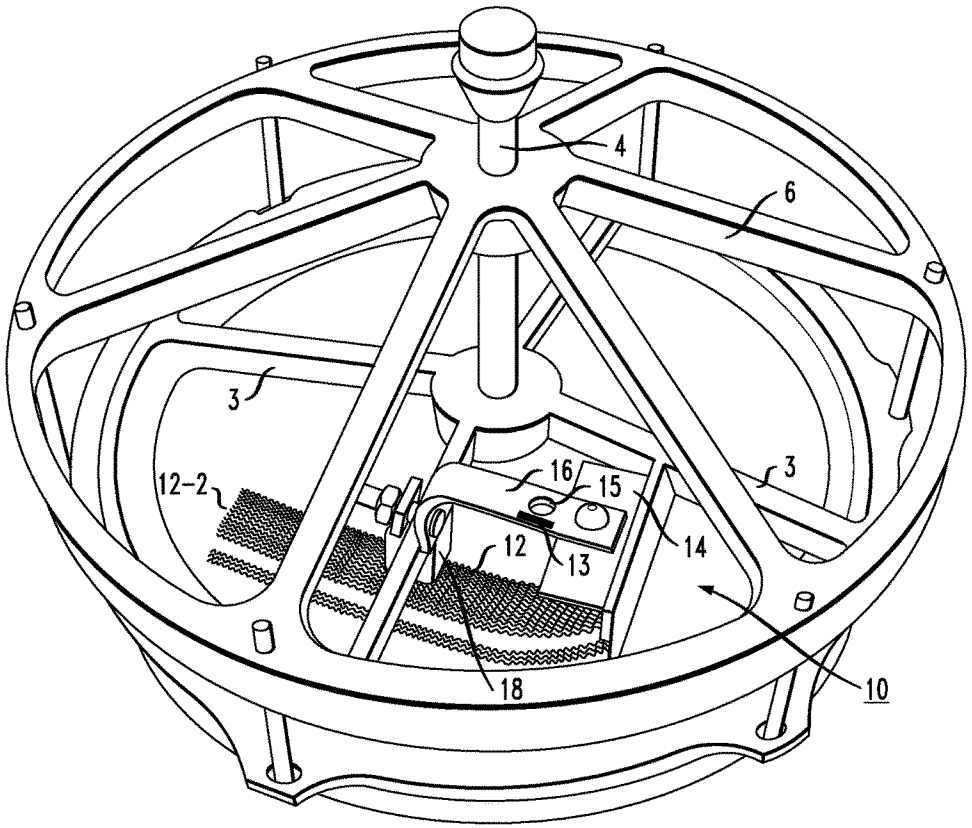
FIG. 6 illustrates an arrangement with the inventive snare device attached to an interior area of a roto-tom drum.

FIG. 6 illustrates snare device 10 as affixed in place on a roto-tom drum, such as the drum shown in FIG. 1. As shown in FIG. 6, snare device 10 is attached a spider arm 3 of adjustable-pitch mechanism 2. The view of FIG. 6 is from the "under side" of the drum, looking into the adjustable pitch mechanism itself. Also shown in this view is a lower tension ring 5 (also shown in FIG. 1) and associated spider arms 6, where the drum is configured to be rotated by the musician to either add or reduce the tension of the drum head (as well as the snare wires 12, in this case). It is to be understood that the orientation of snare device 10 with respect to adjustable-pitch mechanism 2 needs to be designed such that mechanism 2 may be rotated to adjust pitch without changing the physical contact between snare wires 12 and the drum head.

Advantageously, by incorporating the snare device with a roto-tom drum, the ability to rapidly change the pitch of a snare drum is provided—which is not possible with conventional snare drums. Also, as mentioned above, an inventive drum as shown in FIGS. 4 and 5 is able to produce the desired snare effect without needed a lower drum head and associated shell between the lower and upper drum heads, as required for a conventional snare drum. That is, the single drum head (drum head 1) is used in the inventive configuration as both the batter-head and the snare-head—with the associated savings in cost and size.

Also shown in FIG. 6 is a transducer device 13 that may be attached to snare device 10 through, for example, an aperture 15 formed in side bracket 16. Transducer device 13 is a well-known percussion accessory that may be utilizes to transform vibrations (in this case, vibrations of snare wires 12) into a different type of audio signal. Inasmuch as transducer device 13 relies on the presence of a sufficient pressure (as well as vibration) to create the audio signal, snare wires 12 are configured to provide both the necessary pressure and vibration.

Figure 7:
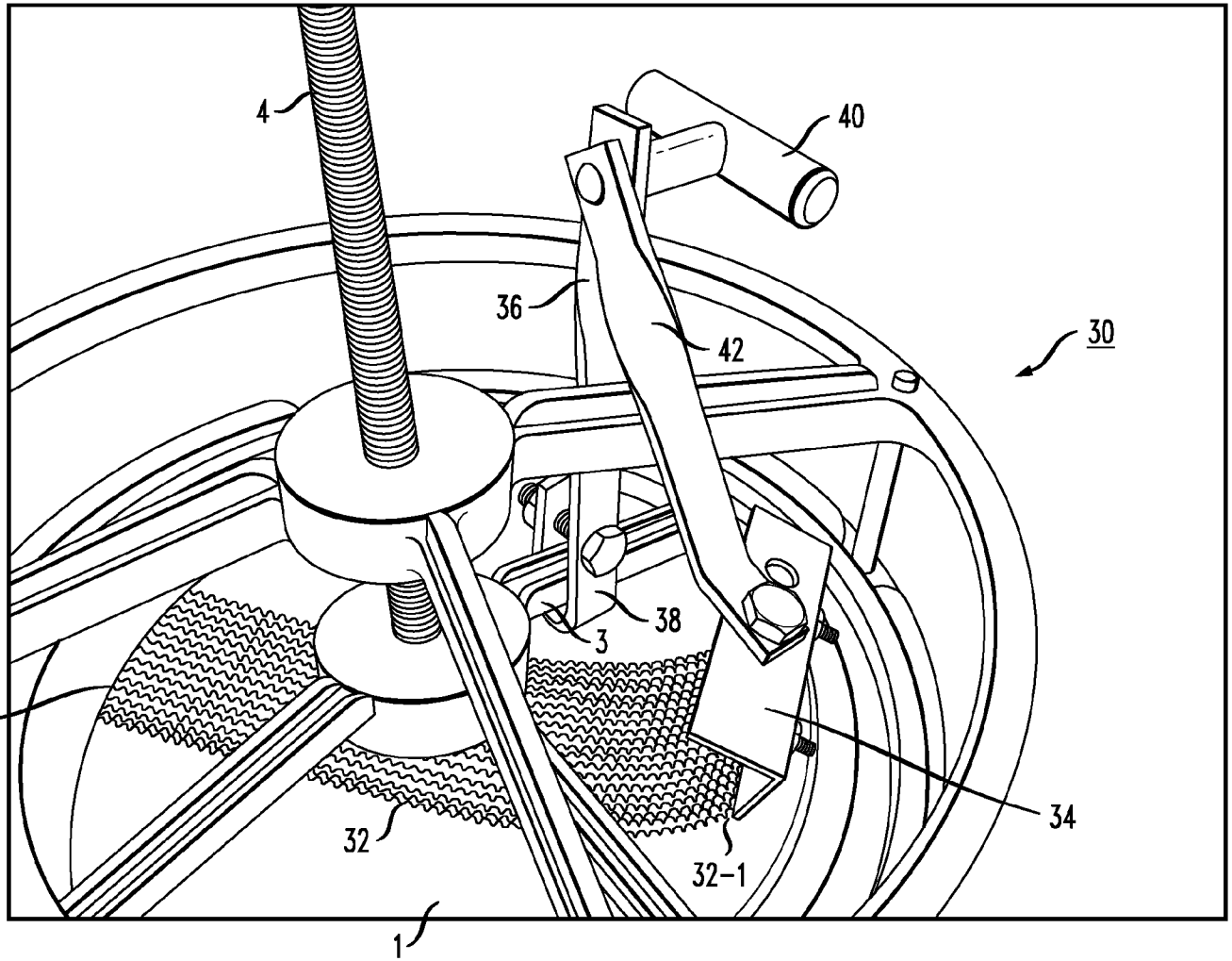
FIG. 7 shows an alternative embodiment of the present invention, in this case including a lever arm to control the positioning of the snare wires of the device with respect to a drum head.

An alternative clamping configuration is contemplated where the snare device can be "lowered" or "raised" to be in contact with the drum head and provide the snare effect on an "as needed" basis. FIG. 7 illustrates an exemplary configuration of this alternative embodiment of the present invention. In particular, FIG. 7 shows an inventive snare device 30 that includes a lever control used to "raise/lower" the snare wires with respect to the drum head in a manner that the snare effect can be controlled. The view in FIG. 7 is again from the underside of a roto-tom drum, which allows for the placement and components of snare device 30 to be clearly shown.

In this case, snare device 30 is attached to spider arm 3 of adjustable pitch mechanism 2 (similar to the attachment as shown in FIG. 4.) and is oriented in a manner such that the "up" and "down" movement of spider arm 3 is unimpeded. Additionally, snare device 30 is configured such that lever arm 40 extends beyond the periphery of the drum, in a location that is easily visible and useable by the musician. Snare device 30 is shown as comprising a plurality of snare wires 32 that are attached at a first end 32-1 to an end termination mount 34. As with the previously-described embodiment, snare wires 32 are formed of an appropriate length L and have an opposing "free" end termination 32-2. A U-shaped clamping configuration 36 is shown as fitting around tension ring 3, and is held in place by a fixing mechanism 38 (allowing snare device 30 to be retro-fit to an existing roto-tom drum). Clamping configuration 36 extends upward ("upward" in the view of the drawing; when used as a drum, this piece extends downward, toward the ground) and is attached to a lever arm 40. Lever arm 40 extends beyond the periphery of the drum, and is used by the musician to control the contact between snare wires 32 and drum head 1. As shown, a connection member 42 extends between lever arm 40 and snare wire end termination mount 34. Connection member 42 is slightly bent to provide the curvature necessary to interconnect lever arm 40 and end termination 34.

In accordance with this embodiment of the present invention, the drummer is able to control the snare action of the drum by raising/lower lever arm 40, which will raise snare wires 32 to contact drum head 1, or lower snare wires 32 to remove them from interacting with the drum head (and therefore, returning the drum action to a conventional timpani sound).

Figure 8:
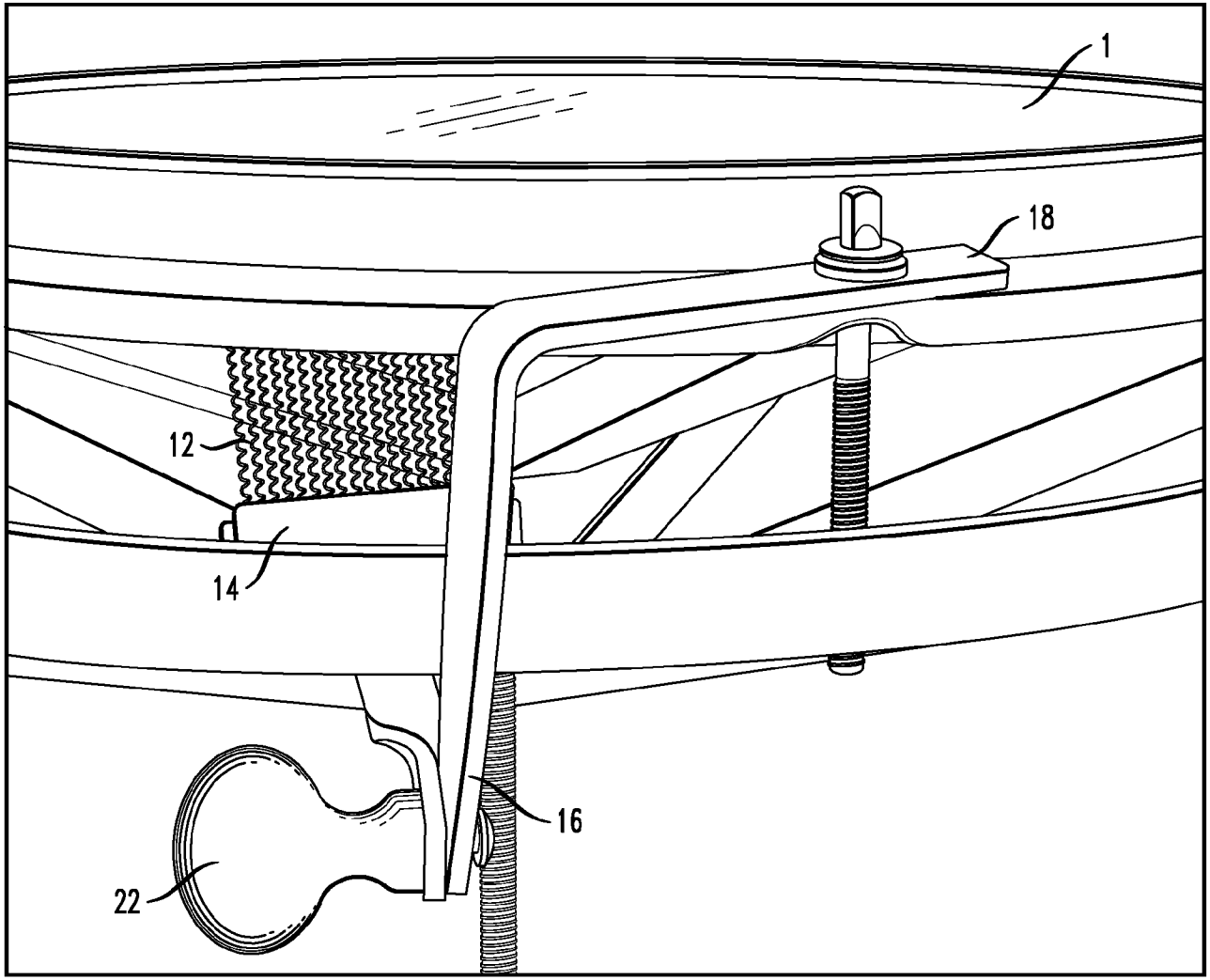
FIG. 8 illustrates an embodiment of the inventive snare device, in this case as removably attached to an exterior portion of a drum.

FIG. 8 illustrates an alternative configuration of snare device 30, in this case illustrating the attachment of device 30 to an exterior portion of a roto-tom drum. Here, a knob 22 is included and is used by the musician to adjust the positioning of snare wires 12 with respect to drum head 1.

While the above-described embodiments of the present invention have illustrated the ability to include the inventive snare device with a roto-tom drum, it is to be understood that the inventive snare device can be incorporated with virtually any type of drum.

Figure 9:
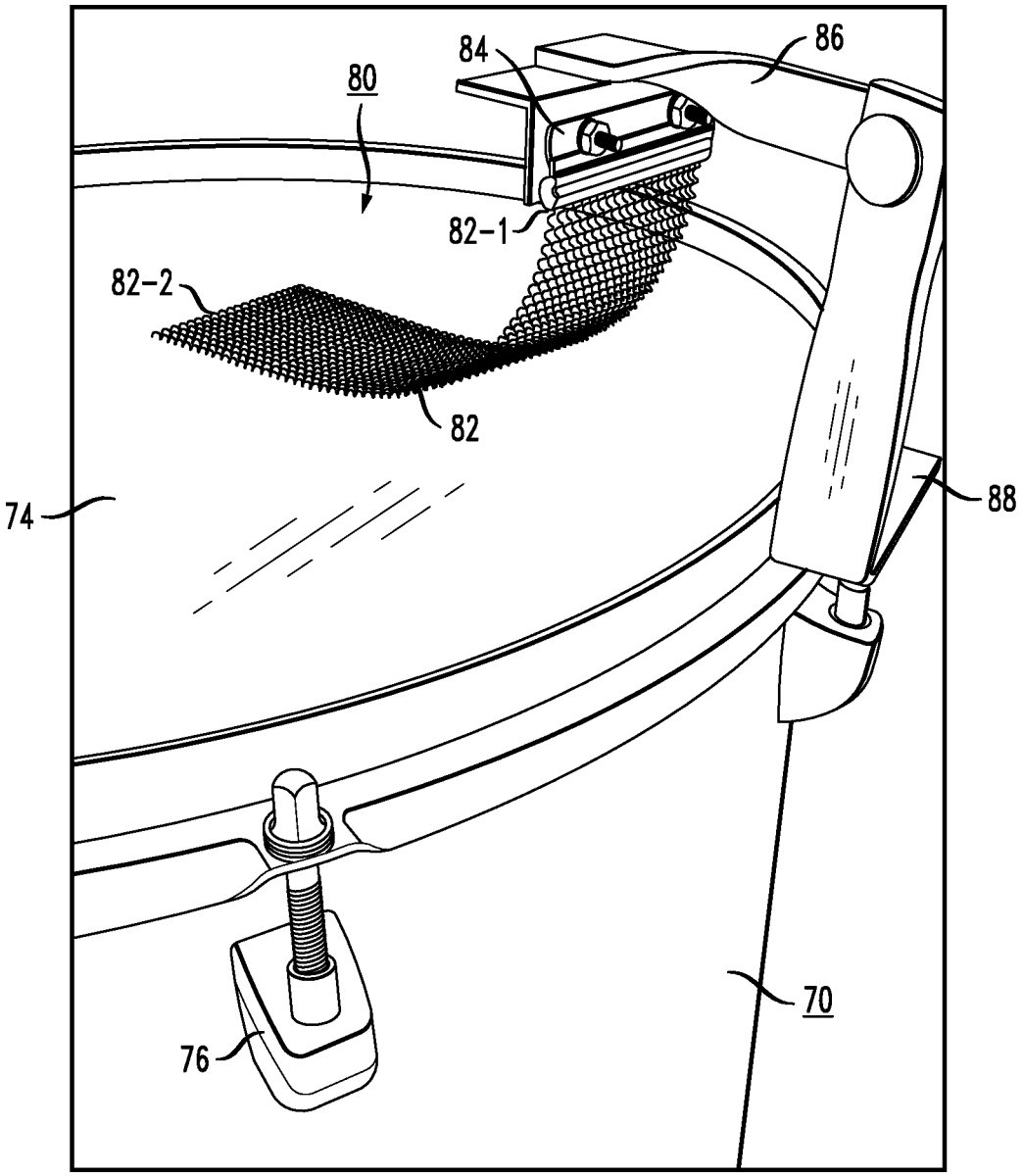
FIG. 9 depicts an embodiment of the inventive snare device, in this case attached to an exterior portion of a shelled drum.

For example, FIG. 9 illustrates an alternative embodiment of the present invention, in this case configured to attach to an external portion of a drum. In particular, FIG. 9 illustrates an exemplary exterior snare device 80 that may be utilized with conventional shelled drums. As with the embodiments described above, snare device 80 comprises a plurality of snare wires 82, with a first end 82-1 of wires 82 fixed in place within an end termination mount 84 (the "free" end 82-2 of snare wires 82 shown as contacting a portion of a drum head 74 of an exemplary drum 70.

Snare device 80 further includes a side bracket 86 that extends between end termination mount 84 and a clamping arrangement 88. In the embodiment of FIG. 9, clamping arrangement 88 is shown as being coupled to a standard tension hoop 76 of drum 70.

As with the embodiment shown in FIG. 7, the externally mounted snare device of the present invention may include a lever arm to control the contact between the snare wires and the drum head. Additionally, it is to be understood that the exterior snare device as shown in FIG. 9 may be utilized with a variety of shelled drums, such as a mounted tom, quad drums, etc.

Figure 10:
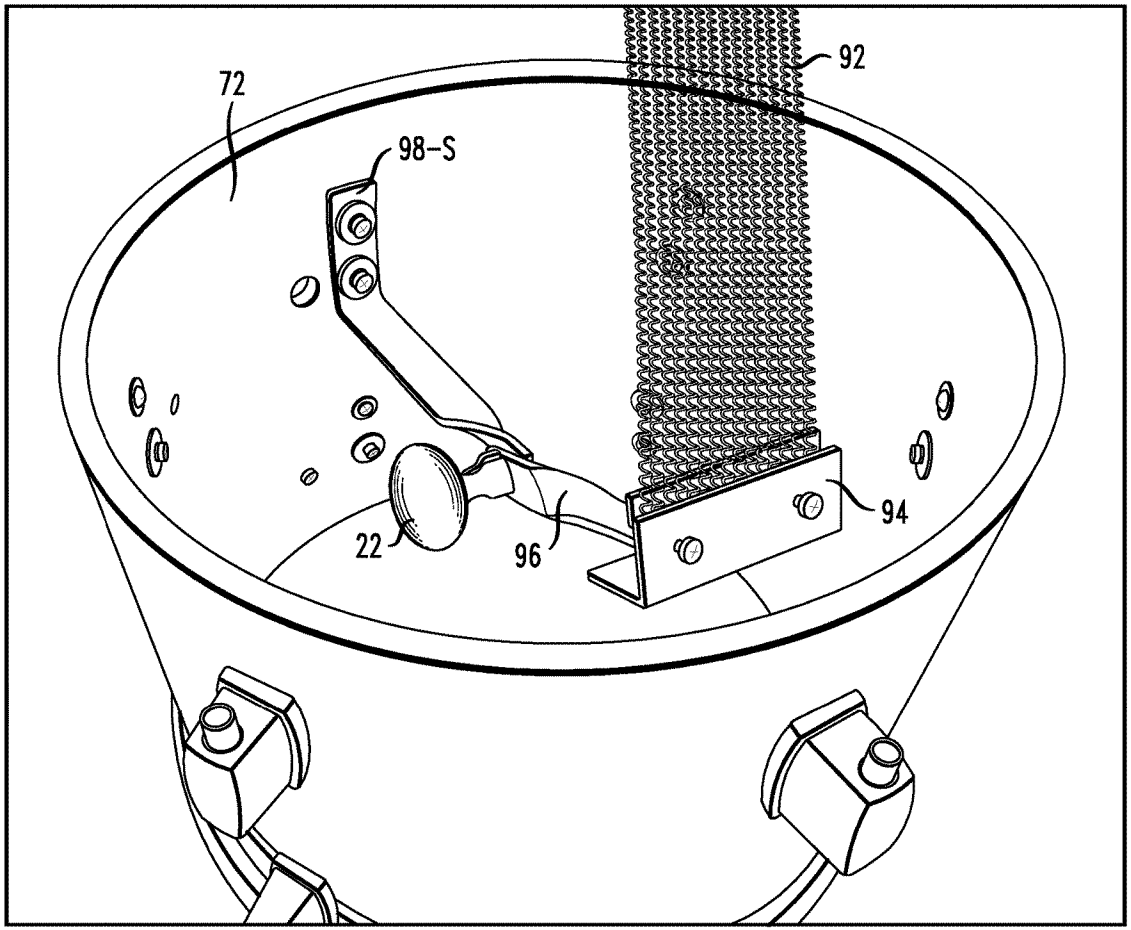
FIG. 10 depicts yet another embodiment of the inventive snare device, where in this case the snare device is attached to an inner portion of a drum shell.

It is also possible to locate the inventive snare device within an interior portion of a shelled drum. FIG. 10 illustrates an exemplary snare device 90 that is attached to an interior area of a shelled drum 70, in particular to shell 72. A particular clamping arrangement 18-S is shown and takes the form of an actual set screw type of arrangement.

In the view of FIG. 10, drum head 74 has not yet been put in place, allowing for snare wires 92 to be in their "natural" straight form, extending in this view upward from end termination mount 94. When drum head 74 is placed in position, snare wires 92 will bend, remaining in contact with the underside of drum head 74 and providing an additional pressure against the underside of drum head 74 and providing an excellent snare effect. This may also be an embodiment where a transducer can be effectively added to the snare device.

As mentioned above, at least one advantage of the snare device of the present invention is that a "shell-less" percussion instrument (such as a roto-tom drum) can be configured to produce a snare sound. As a result, it is possible to include a drum retro-fitted with the inventive snare device to form a "shell-less snare drum" that is lightweight and sturdy, with many fewer parts (and expense) than conventional snare drums. In particular, when used in conjunction with a roto-tom drum, the different tensions applied to the roto-tom head allow for a sensitivity to the snare wires that is very different from a conventional snare drum.

While I have shown and described certain embodiments of my invention, it is to be understood that it is capable of many modifications. Changes, therefore, in the construction and arrangement may be made without departing from the spirit and scope of the invention as disclosed in the claims appended hereto.

What is claimed is:

1. A snare device for use with a toro-tom drum comprising:

a plurality of snare wires having a length L less than a drum diameter, the plurality of snare wires disposed in a planar configuration and having a first end termination and a second, opposing end termination;

an end termination mount attached to only the first end termination of the plurality of snare wires;

a side bracket extending orthogonal from the end termination mount;

a clamping configuration attached to the side bracket and including a clamping device for attaching the snare device to an adjustable pitch mechanism of the roto-tom drum in a manner that the plurality of snare wires extend across only a portion of a drum head, such that the second, opposing end termination of the plurality of snare wires remain unattached from any element of the roto-tom drum; and a lever arrangement for adjusting the position of the plurality of snare wires with respect to the drum head.

2. The snare device of claim 1 wherein the clamping device includes a U-shaped member for placement over a portion of the adjustable pitch mechanism and a locking element for holding the U-shaped member in place.

3. The snare device of claim 2 wherein the locking element comprises a screw.

4. The snare device of claim 1 wherein the end termination mount and attached first end termination of the plurality of snare wires is removably attached to the side bracket.

5. The snare device of claim 4 wherein a wing screw and a plurality of wing nuts are used to removably attach the end termination mount to the side bracket.

6. The snare device of claim 1 wherein the lever arrangement comprises a lever arm for use by an individual to control the positioning of the snare wires; and a connection member coupled between the lever arm and the side bracket, wherein the movement of the lever arm results in a movement of the connection member and an associated movement of the plurality of snare wires with respect to the drum head such that the second, opposing end termination of the plurality of snare wires do not contact the drum head.

* * * * *